US010393433B2

(12) United States Patent
Valia et al.

(10) Patent No.: US 10,393,433 B2
(45) Date of Patent: Aug. 27, 2019

(54) NAIL LAMP

(71) Applicant: Revlon Consumer Products Corporation, New York, NY (US)

(72) Inventors: David Valia, San Diego, CA (US); Daniel Moore, Escondido, CA (US); Thong Vu, Vista, CA (US); Diane Marie Larsen, Vista, CA (US); Guido Charosky, Sant Cugat del Valles (ES); Ignacio Rocchetti, Sant Cugat del Valles (ES)

(73) Assignee: Creative Nail Design Inc., New York, NY (US)

( * ) Notice: Subject to any disclaimer, the term of this patent is extended or adjusted under 35 U.S.C. 154(b) by 103 days.

(21) Appl. No.: 15/679,523

(22) Filed: Aug. 17, 2017

(65) Prior Publication Data

US 2017/0343282 A1 Nov. 30, 2017

Related U.S. Application Data

(63) Continuation of application No. 13/827,389, filed on Mar. 14, 2013, now Pat. No. 9,841,233.

(60) Provisional application No. 61/617,978, filed on Mar. 30, 2012.

(51) Int. Cl.

| | |
|---|---|
| ***A45D 29/00*** | (2006.01) |
| ***A45D 29/18*** | (2006.01) |
| ***F26B 3/347*** | (2006.01) |

(52) U.S. Cl.

CPC ..... *F26B 3/347* (2013.01); *A45D 29/00* (2013.01); *A45D 29/18* (2013.01)

(58) Field of Classification Search

CPC ..... A45D 29/00; A45D 29/18; F26B 3/347

USPC ..... 362/249.02

See application file for complete search history.

(56) References Cited

U.S. PATENT DOCUMENTS

| | | | |
|---|---|---|---|
| 2,218,296 | A | 10/1940 | Perras |
| 2,262,274 | A | 11/1941 | Fingerlin |
| 3,864,847 | A | 2/1975 | Friedman et al. |
| 4,193,209 | A | 3/1980 | Lovison |
| 4,754,769 | A | 7/1988 | Flynn |
| D300,960 | S | 5/1989 | Billings |
| 4,967,775 | A | 11/1990 | Kaiser |
| 4,979,523 | A | 12/1990 | Grimm |
| 5,084,984 | A | 2/1992 | Duchoud |
| 5,103,845 | A | 4/1992 | Matthews |

(Continued)

FOREIGN PATENT DOCUMENTS

| | | | |
|---|---|---|---|
| CN | 201227850 | Y | 4/2009 |
| DE | 202004008982 | U1 | 8/2004 |

(Continued)

OTHER PUBLICATIONS

International Search Report issued in PCT/US2013/034625.

*Primary Examiner* — Tsion Tumebo
(74) *Attorney, Agent, or Firm* — Revlon

(57) ABSTRACT

A nail lamp is configured to cure light-curable nail product on a user's nails. The lamp includes an array of discrete light sources with different light wavelength profiles. The different wavelength profiles are configured to, in combination, cure a light-curable nail product. A space is disposed beneath the array and is sized to accommodate therein the nails of an appendage of a user so as to expose the user's nails to light from the array. The space is substantially open to the ambient environment to the front, rear, left, right, and top of the space, thereby providing an open architecture.

20 Claims, 13 Drawing Sheets

(56) References Cited

U.S. PATENT DOCUMENTS

| | | | |
|---|---|---|---|
| 5,249,367 | A | 10/1993 | Nafziger |
| 5,336,128 | A | 8/1994 | Birdsong |
| D431,682 | S | 10/2000 | Seo |
| D453,858 | S | 2/2002 | Tsai |
| 6,518,583 | B1 | 2/2003 | Hennig |
| D489,489 | S | 5/2004 | Khalaj |
| D492,447 | S | 6/2004 | Mills |
| 7,118,589 | B2 | 10/2006 | Vlahos |
| 7,712,473 | B1 | 5/2010 | Robinson et al. |
| D661,021 | S | 5/2012 | Chang |
| D661,429 | S | 6/2012 | Huthmaker |
| 8,242,475 | B1 | 8/2012 | Cheng |
| 8,286,643 | B2 | 10/2012 | Li |
| 8,450,705 | B1 | 5/2013 | Chen et al. |
| 9,149,106 | B2 | 10/2015 | Park |
| 2002/0181947 | A1 | 12/2002 | Cao |
| 2006/0260628 | A1 | 11/2006 | Chan |
| 2009/0143842 | A1 | 6/2009 | Cumbie |
| 2010/0293805 | A1 | 11/2010 | Chang |
| 2011/0277338 | A1 | 11/2011 | Li et al. |
| 2012/0187311 | A1 | 7/2012 | Vu et al. |
| 2013/0013444 | A1 | 1/2013 | Vandikas et al. |
| 2013/0109001 | A1 | 5/2013 | Pan et al. |
| 2013/0161531 | A1 | 6/2013 | Haile |
| 2014/0124655 | A1 | 5/2014 | Rivero |
| 2014/0168972 | A1 | 6/2014 | Ebner |
| 2016/0370113 | A1 | 12/2016 | Valia |

FOREIGN PATENT DOCUMENTS

| | | | |
|---|---|---|---|
| DE | 202006005790 | U1 | 6/2006 |
| TW | M424054 | | 3/2012 |

NAIL LAMP

CROSS-REFERENCE TO RELATED APPLICATIONS

This patent application is a continuation of co-pending U.S. application Ser. No. 13/827,389 filed on Mar. 14, 2013, the entire contents of which is incorporated herein by reference, and claims the benefit of priority of U.S. Provisional Application No. 61/617,978 filed on Mar. 30, 2012.

BACKGROUND

Field of the Invention

The present invention is generally related to a light-curing nail lamp, which has a light source designed to cure a light-curable nail product on a user's nails.

Description of Related Art

Conventional nail coatings may be classified into two categories: nail polishes (e.g., lacquers, varnish or enamels), and artificial nails (e.g., gels or acrylics). Nail polishes typically comprise various solid components which are dissolved and/or suspended in non-reactive solvents. Upon application and drying, the solids deposit on the nail surface as a clear, translucent or colored film. Typically, nail polishes are easily scratched and are easily removable with solvent, usually within one minute and if not removed as described, will chip or peel from the natural nail in one to five days.

Conventional artificial nails are comprised of chemically reactive monomers, and/or oligomers, in combination with reactive or non-reactive polymers to create systems which are typically 100% solids and do not require non-reactive solvents. Upon pre-mixing and subsequent application to the nail plate, or application and exposure to light (e.g., UV, actinic radiation, other light within or outside the visible spectrum), a chemical reaction ensues resulting in the formation of a long lasting, highly durable cross-linked thermoset nail coating that is difficult to remove. Artificial nails may possess greatly enhanced adhesion, durability, scratch resistance, and solvent resistance when compared to nail polishes.

After applying a light-curable nail product (e.g., gel or acrylic) to a user's nails (e.g., finger nails, toe nails), the user places one or more of their nails under a nail lamp. The nail lamp emits light that cures the light-curable nail product, providing a durable nail product.

SUMMARY OF EMBODIMENTS

One or more embodiments of the present invention provide a nail lamp with improved light-curing characteristics (e.g., faster curing times, more consistent curing at a single nail and/or across a plurality of nails on a user's appendage), improved bulb positioning, an open architecture that permits the user's hands/feet to remain substantially visible and exposed to the ambient environment, a compact stowable size, reduced power consumption, and/or reduced heat generation.

One or more embodiments of the present invention provide a portable, easily carried nail lamp.

One or more embodiments of the present invention provide a nail lamp that focuses curing light on the user's nails while limiting the user's skin exposure to such light.

One or more embodiments of the present invention provide a nail lamp that includes: an array of discrete light sources, wherein at least one of the discrete light sources has a different light wavelength profile than at least one other of the discrete light sources, wherein the different wavelength profiles are configured to cure a light-curable nail product; and a space disposed beneath the array, the space being sized to accommodate therein at least one nail on an appendage of a user. The array of discrete light sources is positioned relative to the space so as to expose the at least one nail to light from the at least one of the discrete light sources and from the at least one other of the discrete light sources.

According to one or more of these embodiments, the light wavelength profile of the at least one of the discrete light sources has a maximum intensity at a wavelength less than 475 nm, and the light wavelength profile of the at least one other of the discrete light sources has a maximum intensity at a wavelength less than 475 nm.

According to one or more of these embodiments, the space is sized to accommodate therein a plurality of nails on the appendage of the user, the array includes a plurality of clusters of said discrete light sources, and each of a plurality of said plurality of clusters includes at least two discrete light sources that have different light wavelength profiles than each other.

According to one or more of these embodiments, the space is sized to accommodate therein all five nails on a hand of the user. The plurality of clusters includes a first cluster that is positioned to direct light from the first cluster's light sources to a nail of a middle finger of the user. The plurality of clusters also includes a second cluster and a third cluster disposed on left and right sides, respectively, of the first cluster. The second and third clusters are positioned to direct light from their respective light sources to nails on the index and ring fingers, respectively, of the user depending on whether the user's right or left hand is disposed in the space. The plurality of clusters also includes a fourth cluster disposed to the left of the second cluster, and a fifth cluster disposed to the right of the third cluster.

According to one or more of these embodiments, the fourth cluster is positioned to direct light from the fourth cluster's light sources to a nail of a pinky finger of the user's left hand, and the fifth cluster is positioned to direct light from the fifth cluster's light sources to a nail of a thumb of the user's left hand. The plurality of clusters includes a sixth cluster disposed to the left of the second cluster and positioned to direct light from the sixth cluster's light sources to a nail of a thumb of the user's right hand, and a seventh cluster disposed to the right of the third cluster and positioned to direct light from the seventh cluster's light sources to a nail of a pinky of the user's right hand.

According to one or more of these embodiments, the lamp also includes a controller having left hand and right hand states. The left hand state is a state that is configured to deliver power to the first through fifth clusters of light sources, but not the sixth or seventh clusters of light sources. The right hand state is a state configured to deliver power to the first through third, sixth, and seventh clusters of light sources, but not the fourth or fifth clusters of light sources.

According to one or more of these embodiments, the space is sized to accommodate therein a plurality of nails on the appendage of the user. The array of discrete light sources is arranged in a U shaped pattern.

According to one or more of these embodiments, the discrete light sources include at least a first plurality of discrete light sources that each have a first light wavelength profile, and a second plurality of discrete light sources that each have a second light wavelength profile. The first light wavelength profile is different than the second light wavelength profile.

According to one or more of these embodiments, the space is sized to accommodate therein a plurality of nails on the appendage of the user. The first and second pluralities of discrete light sources are arranged to expose each of the plurality of nails to light from at least one of said first plurality of discrete light sources and from at least one of said second plurality of discrete light sources.

According to one or more of these embodiments, the array includes a plurality of clusters of said discrete light sources. Each of a plurality of said plurality of clusters can include at least one of said first plurality of discrete light sources, and at least one of said second plurality of discrete light sources.

According to one or more of these embodiments, the first light wavelength profile has a maximum intensity at a wavelength less than 385 nm, and the second light wavelength profile has a maximum intensity at a wavelength greater than 425 nm.

According to one or more of these embodiments, the discrete light sources include a third plurality of discrete light sources that each have a third light wavelength profile. Each of a plurality of said plurality of clusters includes at least one of said third plurality of discrete light sources. The third light wavelength profile has a maximum intensity at a wavelength that is greater than 385 nm and less than 425 nm.

According to one or more of these embodiments, the space is sized to accommodate therein a plurality of nails on the appendage of the user. The array of discrete light sources is arranged to expose each of the plurality of nails to light from a respective set of at least two of the discrete light sources. Each respective set of at least two of the discrete light sources contains discrete light sources with different light wavelength profiles than each other.

According to one or more of these embodiments, the plurality of nails is the five nails on the appendage of the user.

According to one or more of these embodiments, each of the discrete light sources is a light emitting diode.

According to one or more of these embodiments, the space is substantially open to an ambient environment to the front, rear, left, and right of the space.

According to one or more of these embodiments, the space is sized to simultaneously accommodate therein all ten nails on two appendages of a user. The array of discrete light sources is positioned relative to the space so as to expose the ten nails to light from the array.

One or more embodiments of the present invention provide a method of curing light-curable nail product using a nail lamp comprising an array of discrete light sources and a space disposed beneath the array. The method includes receiving at least one nail of a digit of an appendage of a human user in the space. The at least one nail has thereon uncured light-curable nail product. The method also includes exposing the light-curable nail product to light from a first one of the discrete light sources and light from a second one of the discrete light sources. The light from the first one of the discrete light sources has a different light wavelength profile than the light from the second one of the discrete light sources. Said exposing light-cures the nail product.

According to one or more of these embodiments, the light from the first one of the discrete light sources and the light from the second one of the discrete light sources both contribute to said light-curing of the nail product.

According to one or more of these embodiments, said exposing light-cures the nail product in less than 10 minutes.

According to one or more of these embodiments, the light from the first one of the discrete light sources has a maximum intensity at a wavelength less than 475 nm, and the light from the second one of the discrete light sources has a maximum intensity at a wavelength less than 475 nm.

One or more embodiments of the present invention provide a nail lamp comprising: a support having an operative position; a space disposed beneath the support when the support is in its operative position, the space being sized to accommodate therein at least four nails on an appendage of a user; and an array of one or more light sources supported by the support and configured to produce light that is configured to cure a light-curable nail product. The array of one or more light sources is positioned to direct the light onto the at least four nails when the user's appendage is in the space. When the support is in the operative position, the space is substantially open to an ambient environment to the front and rear of the space.

According to one or more of these embodiments, when the support is in the operative position, the space is substantially open to the ambient environment to the left and right of the space.

According to one or more of these embodiments, the at least four nails on the appendage of the user includes all five nails on the appendage of the user.

According to one or more of these embodiments, the support is U-shaped, and the space is substantially open to the ambient environment above the space except for the support.

According to one or more of these embodiments, the lamp also includes a base. The support is connected to the base for movement relative to the base between the operative position and a stowed position.

One or more embodiments of the present invention provide a method of curing light-curable nail product using a nail lamp that includes a support, an array of one or more light sources connected to the support, and a space disposed beneath the array, the space being substantially open to an ambient environment to the front and rear of the space. The method includes receiving at least four nails on an appendage of a user in the space. The at least four nails have thereon uncured light-curable nail product. The method also includes exposing the light-curable nail product to light from the array of one or more light sources. Said exposing to light cures the nail product on the at least four nails.

According to one or more of these embodiments, the space is substantially open to the ambient environment to the left and right of the space.

According to one or more of these embodiments, the at least four nails include thumb, index, middle, ring, and pinky nails on a hand of the user. After said receipt of the thumb, index, middle, ring, and pinky nails, the index, middle, ring, and pinky nails are visible from a front of the nail lamp.

According to one or more of these embodiments, the support is a U-shaped, and the space is substantially open to the ambient environment above the space except for the support.

According to one or more of these embodiments, the nail lamp includes a base, and the support is connected to the base for movement relative to the base between an operative position that provides the space and a stowed position.

According to one or more of these embodiments, the base forms a platform configured to support the user's appendage. The platform defines a bottom of the space when the support is in the operative position.

According to one or more of these embodiments, the support is pivotally connected to the base for movement relative to the base between the operative and stowed positions.

One or more embodiments of the present invention provide a nail lamp that includes: a first housing portion; a second housing portion connected to the first housing portion for movement relative to the first housing portion between an operative position and a stowed position; a space disposed between the housing portions when the second housing portion is in its operative position, the space being sized to accommodate therein at least one nail on an appendage of a user; and an array of one or more light sources supported by the second housing portion and configured to produce light that is configured to cure a light-curable nail product. When the second housing portion is in the operative position and the user's at least one nail is in the space, the array of one or more light sources is positioned to direct the light onto the at least one nail.

According to one or more of these embodiments, when the second housing portion is in the operative position, the space is substantially open to an ambient environment to the front and rear of the space.

According to one or more of these embodiments, the space is sized to accommodate therein all five nails on the appendage of the user. When the second housing portion is in the operative position and the user's appendage is in the space, the array of one or more light sources is positioned to direct the light onto the five nails.

According to one or more of these embodiments, the first housing portion includes a platform that is configured to support at least a portion of the user's appendage. The platform defines a bottom of the space when the second housing portion is in the operative position.

According to one or more of these embodiments, the second housing portion pivotally connects to the first housing portion for movement relative to the first housing portion between the operative and stowed positions.

According to one or more of these embodiments, the nail lamp is more compact when the second housing portion is in the stowed position than when the second housing portion is in the operative position.

According to one or more of these embodiments, the second housing portion and first housing portion enclose the array of one or more light sources when the second housing portion is in the stowed position.

One or more embodiments of the present invention provide a method of curing light-curable nail product using a nail lamp that has a first housing portion, a second housing portion connected to the first housing portion for movement relative to the first housing portion between an operative position and a stowed position, a space disposed between the housing portions when the second housing portion is in its operative position, and an array of one or more light sources supported by the second housing portion and configured to produce light that is configured to cure a light-curable nail product. The method includes positioning the second housing portion in the operative position. The method also includes receiving at least one nail on an appendage of a user in the space, the at least one nail having thereon uncured light-curable nail product. The method further includes exposing the light-curable nail product to light from the array of one or more light sources. Said exposing to light cures the nail product on the at least one nail.

According to one or more of these embodiments, the at least one nail includes all five nails on an appendage of the user. The method includes receiving the five nails in the space, each of the five nails having thereon uncured light-curable nail product. The method further includes exposing the light-curable nail product on each of the five nails to light from the array of one or more light sources. Said exposing to light cures the nail product on each of the five nails.

These and other aspects of various embodiments of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the invention, the structural components illustrated herein are drawn to scale. It is to be expressly understood, however, that the drawings are for the purpose of illustration and description only and are not intended as a definition of the limits of the invention. In addition, it should be appreciated that structural features shown or described in any one embodiment herein can be used in other embodiments as well. As used in the specification and in the claims, the singular form of "a," "an," and "the" include plural referents unless the context clearly dictates otherwise.

BRIEF DESCRIPTION OF THE DRAWINGS

For a better understanding of the embodiments of the present invention, as well as other objects and further features thereof, reference is made to the following description, which is to be used in conjunction with the accompanying drawings, where.

DETAILED DESCRIPTION OF EXEMPLARY EMBODIMENTS

Figure 1:
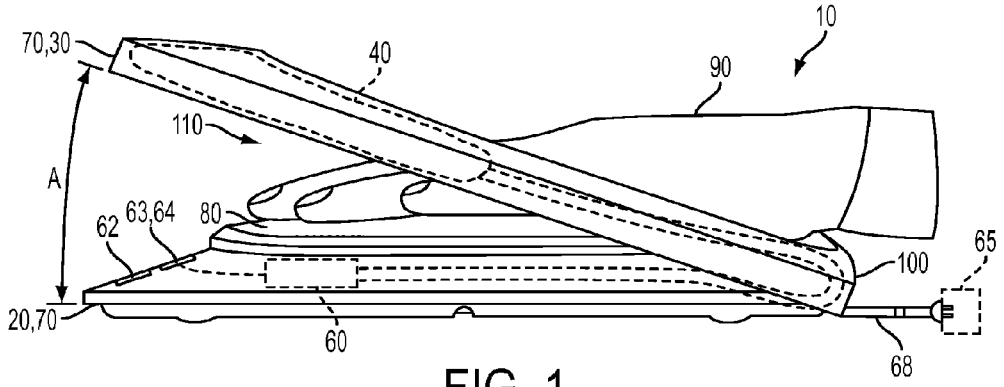
FIG. 1 is a left side view of a nail lamp according to an embodiment of the present invention.

FIGS. 1-6 illustrate a nail lamp 10 according to an embodiment of the present invention. The lamp 10 includes a base 20, a support 30 movably mounted to the base 20, an array 40 of discrete light sources 50 supported by the support 30 (FIG. 6), and a controller 60 (FIG. 1).

Figure 2:
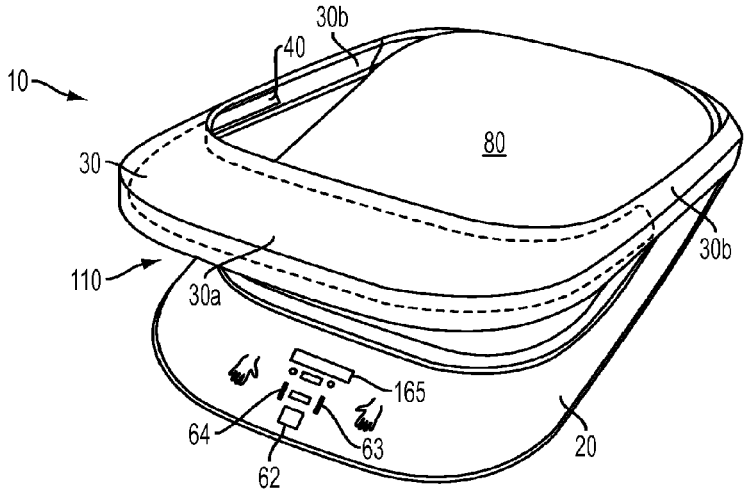
FIG. 2 is a left perspective view of the nail lamp of FIG. 1.

As used herein, the front of the lamp 10 means the direction toward which a user's digits extend during use (to the left as shown in FIG. 1, toward the bottom as shown in FIG. 2). Conversely, the rear of the lamp 10 is opposite side (to the right as shown in FIG. 1, toward the top as shown in FIG. 2). The left side of the lamp 10 extends out of the page in FIG. 1, and the right side of the lamp 10 extends into the page in FIG. 1. The top of the lamp 10 extends upwardly in FIG. 1 and the bottom of the lamp conversely extends downwardly in FIG. 1.

As shown in FIGS. 1-5, the base 20 (e.g., a first housing portion) and support 30 (e.g., a second housing portion) together define a housing 70 of the lamp 10.

As shown in FIGS. 1-5, the base 20 is adapted to lay on and be supported by a horizontal surface such as a table top. The base 20 includes a platform 80 that is configured to support a user's appendage 90 (i.e., a hand or foot).

Figure 3:
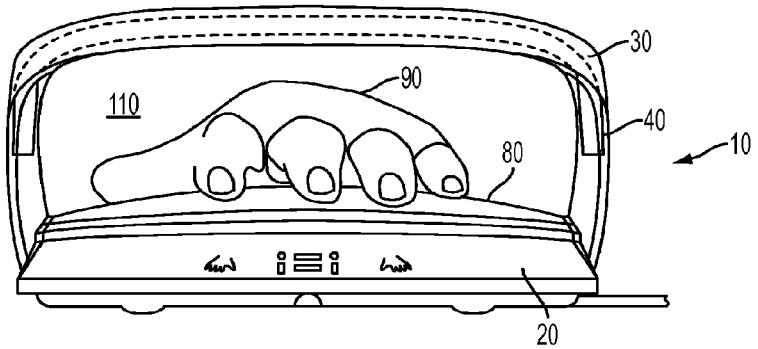
FIG. 3 is a front view of the nail lamp of FIG. 1.
Figure 4:
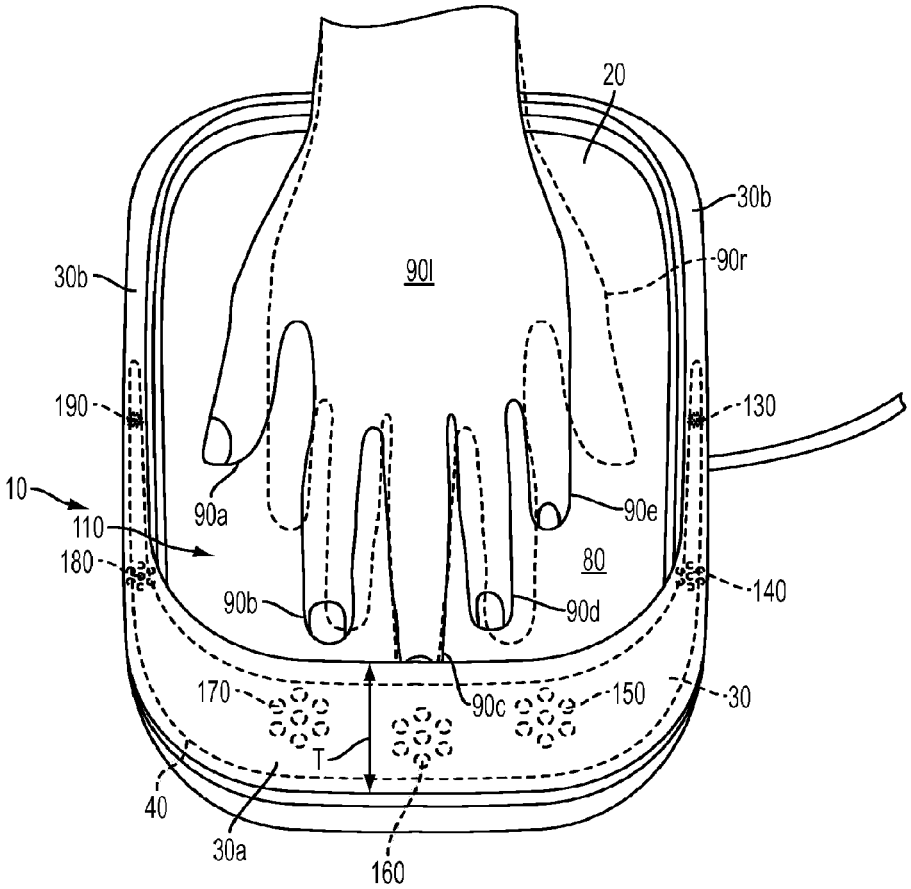
FIG. 4 is a top view of the nail lamp of FIG. 1.
Figure 5:
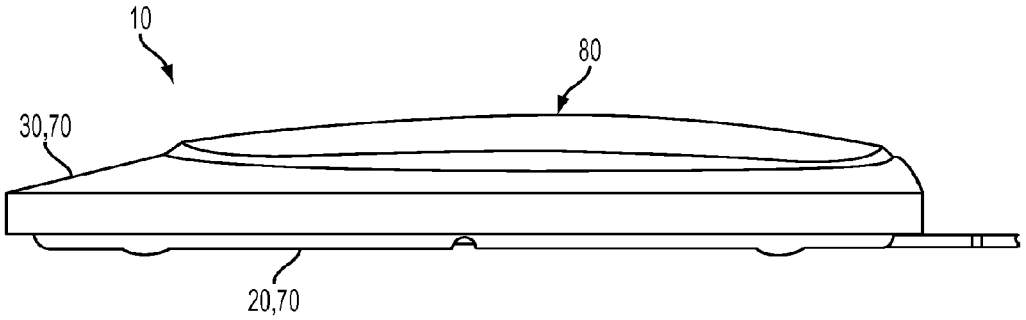
FIG. 5 is a left side view of the nail lamp of FIG. 1 with a support in a stowed position.

The support 30 pivotally connects to the base 20 for movement relative to the base 20 about a pivot axis 100 (see FIG. 1) between an operative position (shown in FIGS. 1-4) and an inoperative, stowed position (shown in FIG. 5). The support 30 pivots over an arc A (FIG. 1) that separates the operative and stowed pivotal positions. According to various embodiments, the arc A is greater than 10 degrees, greater than 20 degrees, and/or about 25 degrees. The lamp 10 is more compact when the support 30 is in the stowed position (FIG. 5) than when the support 30 is in the operative position (FIGS. 1-4). The stowed position facilitates easier storage and transportation of the lamp 10. According to various embodiments and as shown in FIG. 5, the array 40 of light sources 50 is enclosed within the lamp 10's housing (i.e., by being enclosed between the base 20 and the support 30) when the support 30 is in the stowed position. Consequently, positioning the support 30 in the stowed position protects the array 40 of light sources 50 during transportation and storage.

Although the illustrated lamp 10 relies on a pivotal connection between the base 20 and support 30 to facilitate movement between the operative and stowed positions, the support 30 may alternatively movably connect to the base 20 using any other suitable type of connection (e.g., four-bar linkage, sliding connection, etc.) without deviating from the scope of the present invention.

Alternatively, the support 30 could be rigidly connected to the base 20 without deviating from the scope of the invention. In such an embodiment, the support 30 would be permanently disposed in its operative position (for example, as illustrated by the lamp 3010 in FIGS. 14 and 15).

Moreover, the base 20 could be eliminated altogether without deviating from the scope of the present invention. For example, the components of the lamp 10 could be integrated into the support 30 such that the surface on which the support 30 is placed for use (e.g., table top) forms the platform 80 on which users place their nails.

According to various embodiments, left and right sides of the support 30 may be separable from each other (or pivotally connected to each other) to facilitate disassembly of the support 30 (e.g., to provide a more compact unit when not being used).

When the support 30 is in the operative position, a space 110 is defined by the support 30/array 40 and the platform 80 (e.g., beneath the array 40). As shown in FIGS. 1, 3, and 4, the space 110 is sized to accommodate therein all five nails 90*a*, 90*b*, 90*c*, 90*d*, 90*e* (see FIG. 4) on the appendage 90 of the user. The platform 80 defines a bottom of the space 110. In an embodiment that omits the base 20, a flat surface on which the support 30 was placed would define the bottom of the space 110. Moving the support 30 from the operative position to stowed position reduces a size of the space 110, and may eliminate the space 110. According to one or more embodiments, when the support 30 is in the stowed position, the space 110 (if present at all) may be inaccessible to a user because the space 110 is enclosed along with the light sources 50 between the support 30 and base 20.

As used herein, the term "nails" (e.g., the nails 90*a*, 90*b*, 90*c*, 90*d*, 90*e*) encompasses natural nails, artificial nails, and/or artificial nail tips.

Although the illustrated platform 80 and space 110 are sized to accommodate all five nails of a user's appendage 90, the platform 80 and space 110 may alternatively be sized to simultaneously accommodate a greater or fewer number of nails. For example, the platform 80 and space 110 may be sized to simultaneously accommodate the user's four nails 90*b*, 90*c*, 90*d*, 90*e*; sized to accommodate one nail at a time; or sized to simultaneously accommodate both of the user's hands (or feet) so as to accommodate all ten of the user's finger (or toe) nails (for example, the nail lamp 4010 discussed below).

When the support 30 is in the operative position, the structure of the lamp 10 provides an open architecture in which the space 110 is partially and/or substantially open to the ambient environment around the lamp 10 in a variety of directions (e.g., to the front, rear, left, right, and/or top of the space 110). As shown in FIG. 4, the U shape of the support 30 helps to facilitate this open architecture and provides a suitable structural connection between the U-shaped light array 40 and the base 20. As shown in FIG. 4, the curved part 30*a* of the U-shape of the support 30 is disposed toward the front of the lamp 10 (bottom of FIG. 4), while the ends 30*b* of the U-shape extend toward the rear of the lamp 10 (top of FIG. 4). As shown in FIGS. 1-4, although the overall support 30 is generally rectangular or O-shaped, the rectangle or "O" includes within it a U-shape. As used herein, the term "U-shaped" broadly encompasses a variety of bulging shapes (e.g., a horseshoe shape, a J-shape, a C-shape, a continuous or discontinuous curved shape having constant or changing radii of curvature, a "U" formed by three straight lines connected at 90 degree angles, etc.). The U-shape preferably generally follows the curved pattern of the nails 90*a*, 90*b*, 90*c*, 90*d*, 90*e* of a user's appendage 90. More preferably, the U-shape generally follows the curved nail pattern of overlaid left and right appendages 901 and 90*r*, respectively of a user so that the lamp 10 is designed for use by both the left appendage 901 and right appendage 90*r*. FIG. 4 illustrates such overlaid appendages 90 by showing a left hand 901 in solid lines and an overlaid right hand 90*r* in dotted lines.

As viewed from above as shown in FIG. 4, the support 30 is preferably thin so that the space 110 remains substantially open to the environment above the lamp 10. According to various embodiments, a thickness T of the support 30 (as shown in FIG. 4) remains less than 4, 3, 2.5, and/or 2 inches throughout the U-shape. In the illustrated support 30, the thickness T is the largest toward the middle of the U-shape, and is narrower on the left and right sides (e.g., less than 1 inch thick, less than 0.5 inches thick at the sides).

As used herein, the term "substantially open" with respect to a direction means that at least 40% of a projected area of the space 110 in that direction (e.g., front, rear, left, right) is unobstructed by the structure of the lamp 10. For example, as shown in FIG. 1, the space 110 is substantially open to the ambient environment to the left of the lamp 10 despite the limited (i.e., less than 50%) obstruction caused by the left side of the support 30. Similarly, as shown in FIG. 4, the space 110 is substantially open to the ambient environment above the lamp 10 despite the limited (i.e., less than 50%) obstruction caused by the support 30. According to one or more embodiments, the at least 20%, 30%, 40%, 50%, 60%, 70%, 80%, and/or 90% of a projected area of the space in one or more directions (e.g., front, rear, left, right, top) may be unobstructed by the structure of the lamp 10.

Figure 6:
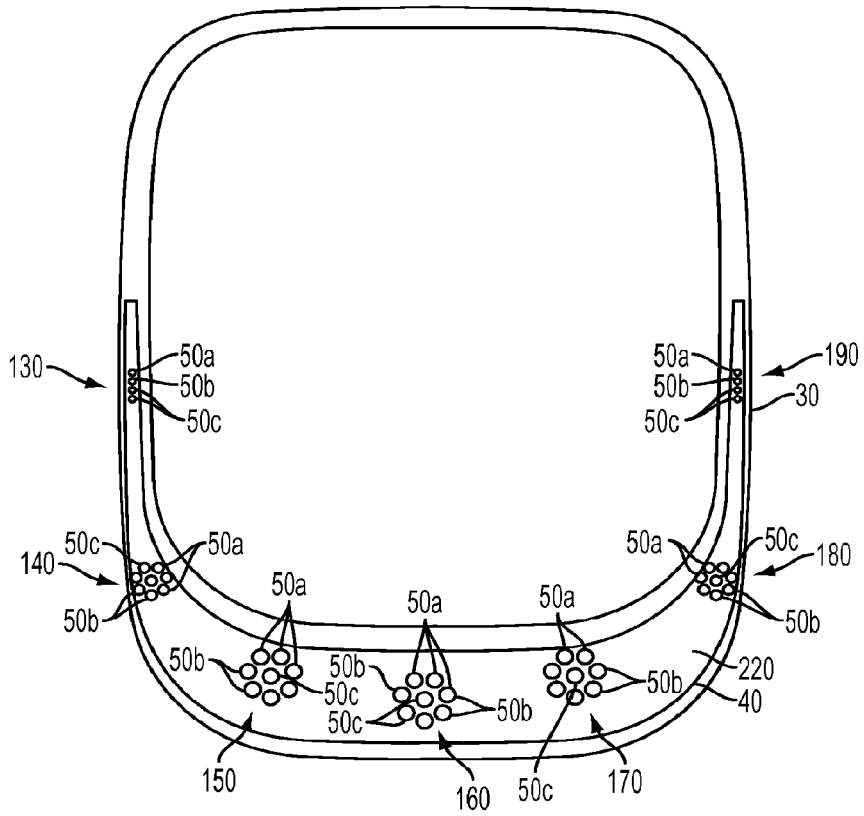
FIG. 6 is a bottom view of the support of the nail lamp of FIG. 1.

The array 40 of discrete light sources 50 is supported by the support 30 and is positioned relative to the space 110 so as to direct light from the light sources 50 to the user's five nails 90*a*, 90*b*, 90*c*, 90*d*, 90*e*. As shown in FIGS. 4 and 6, the array 40 of discrete light sources 50 is divided into a plurality of clusters 130, 140, 150, 160, 170, 180, 190 of light sources 50. As shown in FIG. 6, the plurality of clusters are arranged in a U-shaped pattern that follows the U-shape of the support 30 and the user's nails.

The array 40 may be removably mounted to the support 30 (e.g., via manually actuatable clip(s), screws, etc.) such that an array 40 may be easily replaced with a different array 40 having different characteristics (e.g., different light wavelength profiles designed to cure different nail products, different light source 50 positioning designed to accommodate a different set of nail(s)). For example, separate interchangeable arrays 40 may be provided for each of the user's right and left hands and feet. Although the arrays are illustrated throughout this description as containing a number and arrangement of discrete light sources 50 of a particular size, any array may include more or fewer discrete light sources 50 and may be arranged in any suitable pattern. It is specifically noted that the invention may utilize a fewer number of higher intensity discrete light sources 50 where each of the discrete light sources 50 is physically larger in size. Similarly, the clusters may contain fewer or more discrete light sources 50. For example, in embodiments that include two sets of discrete light sources 50 having two different wavelength profiles (as described further below), a cluster may be two lights; and in embodiments that include three sets of discrete light sources 50 having three different wavelength profiles, a cluster may be two or three lights.

As shown in FIG. 4, the cluster 160 is positioned to direct light from the cluster's light sources 50 to a nail 90*c* of a middle finger of the user's left or right hand. The clusters 150, 170 are disposed on left-rear and right-rear sides, respectively, of the cluster 160 and are positioned to direct light from their respective light sources 50 to nails 90*d*, 90*b* on the index and ring fingers, respectively, of the user's hand, depending on whether the user's right or left hand 90 is disposed in the space 110. The cluster 140 is disposed to the left-rear of the cluster 150 and is positioned to direct light from the light sources 50 of the cluster 140 to the pinky nail 90*e* of the user's left hand. Similarly, the cluster 180 is disposed to the right-rear of the cluster 170 and is positioned to direct light from the light sources 50 of the cluster 180 to the pinky nail of the user's right hand. The cluster 190 is disposed to the right-rear of the cluster 180 and is positioned to direct light from the light sources 50 of the cluster 190 to the thumb nail 90*a* of the user's left hand. Similarly, the cluster 130 is disposed to the left-rear of the cluster 140 and is positioned to direct light from the light sources 50 of the cluster 130 to the thumb nail of the user's right hand.

The clusters 140, 150, 160, 170, 180 project light generally downwardly toward and onto the user's nails 90*b*, 90*c*, 90*d*, 90*e*. Because the thumb nail 90*a* is angled at about 60° from a horizontal orientation of the user's other four nails, the thumb-specific clusters 130, 190 may be oriented at matching angles, for example a 60° angle, a 45° angle or a 90° angle, so as to more perpendicularly project light toward and onto the user's thumb nail 90*a*.

Although the positioning of the clusters has been described as accommodating a user's hand appendage 90, the clusters may additionally or alternatively be positioned to direct light from the light sources 50 to the nails of the user's foot appendage.

As shown in FIG. 1, the controller 60 operatively connects the light sources 50 to a power source 65 (e.g., a DC battery, 110V AC wall socket). As shown in FIG. 1, the controller 60 includes a manually-actuatable switch 62 that a user may actuate to turn the lamp 10 ON and OFF (i.e., by electrically connecting/disconnecting the light sources 50 to/from the power source 65. The controller 60 can be any type of suitable controller (analog or digital circuit, electromechanical switch, programmed chip-based CPU, etc.).

In the illustrated embodiment, the power source 65 is an external power source that connects to the controller 60 via suitable wires 68 (e.g., an electrical plug for use with a wall socket electrical outlet). However, the power source 65 (e.g., a battery power source) may alternatively be housed within the housing 70 (e.g., within the base 20) without deviating from the scope of the present invention.

The controller 60 has left hand and right hand ON states. In the left hand ON state, the controller 60 delivers electric power to the clusters 140, 150, 160, 170, 190 so as to direct light to the nails of the user's left hand, while not delivering power to the right-hand specific clusters 130, 180. Conversely, in the right hand ON state, the controller 60 delivers electric power to the clusters 130, 150, 160, 170, 180 so as to direct light to the nails of the user's right hand, while not delivering power to the left-hand specific clusters 140, 190. The controller 60 may cycle through the OFF, left hand ON, and right hand ON states in a variety of ways. In a manual embodiment, the controller may be configured to sequentially cycle to the next of the OFF, left hand ON, and right hand ON (or vice versa) states in response to sequential manual actuation of the switch 62 (e.g., a momentary switch) or another switch. In an automated embodiment, the controller 60 may be configured to respond to actuation of the switch 62 by going into one of the left hand and right hand ON states for a predetermined period of time, thereafter automatically going into the other of the left and right hand ON states for a predetermined period of time, and then automatically returning to the OFF state. As shown in FIG. 2, left and right hand indicator lights 63, 64, respectively, operatively connect to the controller 60 and are selectively illuminated by the controller 60 to indicate whether the lamp 10 is in the left hand or right hand ON state. The controller 60 may provide an audible alert when switching between the different states to indicate to the user to switch hands, or that the predetermined time has elapsed. The predetermined time may be adjustable by a user so as to correspond to an appropriate curing time for the light-curable (e.g., photopolymerizable) product on the user's nails.

As shown in FIG. 2, a display 165 (e.g., LCD, LED, etc.) is operatively connected to the controller 60 and displays a time remaining for a current curing procedure. Curing times may be tailored to account for various lamp 10 and nail product parameters (e.g., the particular light sources 50 being used (e.g., their intensity and wavelength profiles), the light sources' distance to the nails and angle of incidence on the nails, the type of nail product, etc.). According to various embodiments, the lamp 10 may cure the uncured nail product on a user's nail in less than 10 minutes, less than 5 minutes, less than 3 minutes, less than 2 minutes, less than 1 minute, less than 30 seconds, and/or less than 15 seconds. According to various embodiments, the cure time may be between 5 seconds and 10 minutes. According to one embodiment, the cure time for a base coat is about 10-20 seconds, and the cure time for a subsequent color coat or top coat is about 0-2 minutes, 30-90 seconds, and/or 60-90 seconds.

In the illustrated embodiment, thumb-specific clusters 130, 190 are discrete from the pinky-specific clusters 140, 180. However, according to an alternative embodiment, the clusters 180,190 may be integrated with each other and the clusters 130, 140 may be integrated with each other so that a single cluster accommodates the pinky on one hand and the thumb on the other hand, depending upon which hand the user places in the space 110. In such an embodiment, a single ON state would replace the discrete left hand and right hand ON states of the illustrated lamp 10.

In an embodiment in which the platform 80 and space 110 are sized to simultaneously accommodate both of the user's overlaid hands 90 (e.g., similar to the left and right hand positions shown in FIG. 4, but with the top hand 90 pulled rearwardly relative to the bottom hand 90 so that all ten nails are exposed), the controller 60 may simultaneously turn on all of the clusters 130, 140, 150, 160, 170, 180, 190. In such an embodiment, one or more of the clusters 130, 140, 150, 160, 170, 180, 190 may be elongated in the front/rear direction (up/down as viewed in FIG. 4) to simultaneously accommodate the nails on the user's relatively forwardly disposed lower hand 60 and relatively rearwardly disposed upper hand 90.

According to an alternative embodiment, the switch 62 may be automatically actuated by moving the support 30 between the operative and stowed positions. For example, moving the support 30 from the stowed position to the operative position may actuate the switch 62, which causes the controller 60 to move into an ON state that turns on some or all of the light sources 50. Conversely, moving the support 30 from the operative position to the stowed position may actuate the switch 62 and cause the controller to move into the OFF state that turns off the light sources 50.

While the switch 62 is disposed on the base 20 in the illustrated lamp 10, the switch 62 may alternatively be disposed in any other suitable location (e.g., on the support 30, integrated into the electric cord 68).

According to one or more embodiments, the use of nail-specific clusters 130, 140, 150, 160, 170, 180, 190 focuses light on the user's nails while reducing the user's skin exposure to such light.

As explained hereinafter, the array 40 of discrete light sources 50 includes light sources 50*a*, 50*b*, 50*c* that have different light wavelength profiles. The combination of different light wavelength profiles may improve the light-curing characteristics of the lamp 10 (e.g., by providing more rapid curing, by providing more even curing throughout the thickness of a light-curable nail product on a single nail, by enabling full curing with a lower overall light intensity than in various conventional nail lamps). For example, different wavelength light may penetrate the light-curable nail product to a different extent, thereby improving the overall curing of the light-curable nail product throughout the thickness of the nail product.

As shown in FIG. 6, each of the clusters 130, 140, 150, 160, 170, 180, 190 of discrete light sources 50 include a combination of discrete light source(s) 50*a*, light discrete light source(s) 50*b*, and discrete light source(s) 50*c*. The different clusters 130, 140, 150, 160, 170, 180, 190 preferably each include at least one light source 50*a*, at least one light source 50*b*, and at least one light source 50*c*. Each cluster 130, 140, 150, 160, 170, 180, 190 more preferably includes a plurality of each type 50*a*, 50*b*, 50*c* of light source 50. However, one or more of the clusters 130, 140, 150, 160, 170, 180, 190 may omit light sources 50 from one or more of the light source types 50*a*, 50*b*, 50*c* without deviating from the scope of the present invention.

Figure 7:
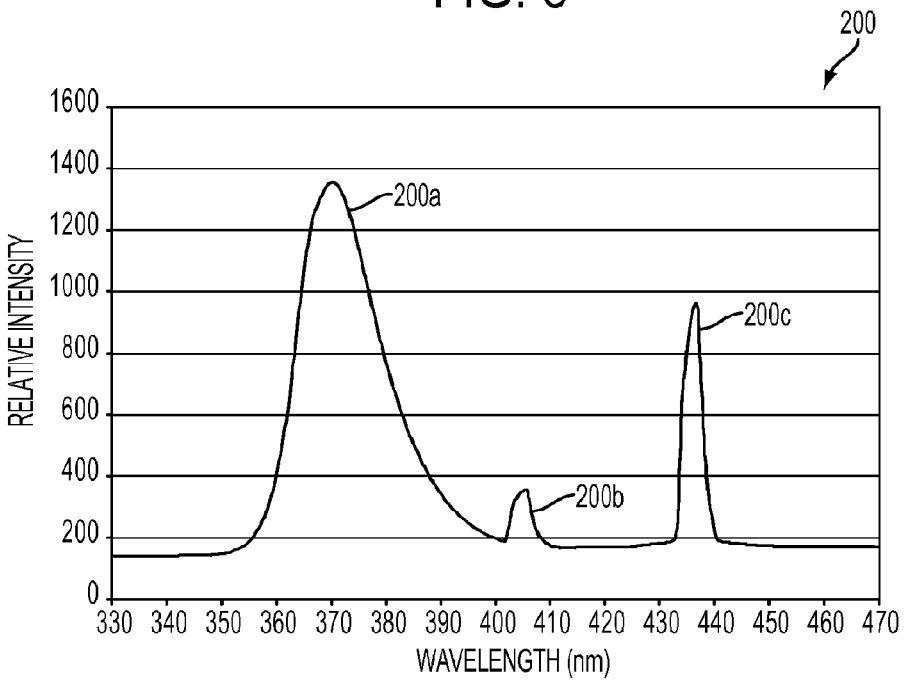
FIG. 7 is a graph illustrating a light wavelength profile of a light source cluster of the nail lamp of FIG. 1.
Figure 8:
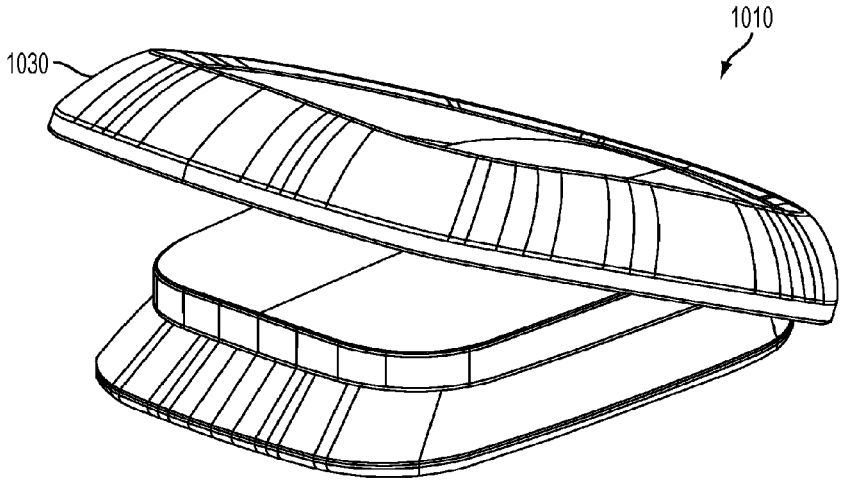
FIG. 8 is a left perspective view of a nail lamp according to an alternative embodiment.
Figure 9:
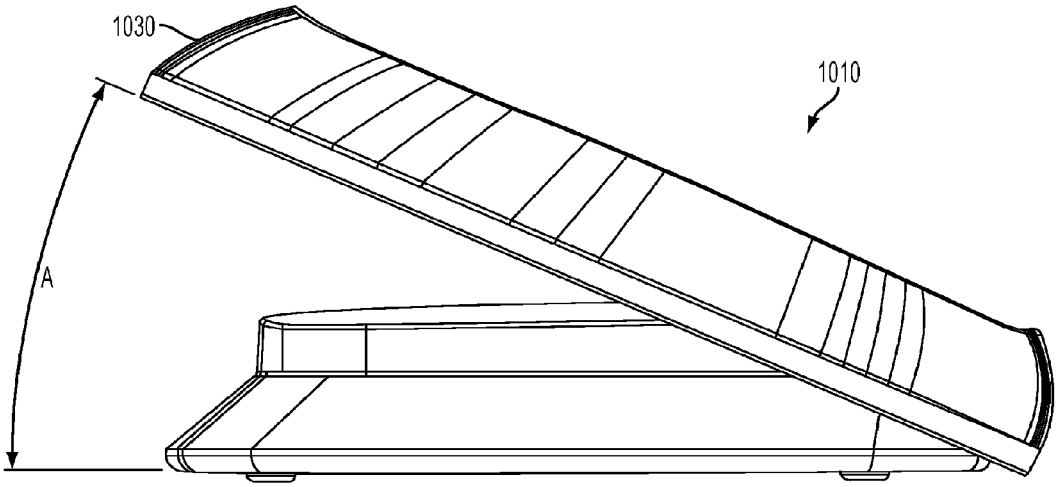
FIGS. 9 and 10 are left side views of the nail lamp of FIG. 8 with the support in operative and stowed positions, respectively.
Figure 10:
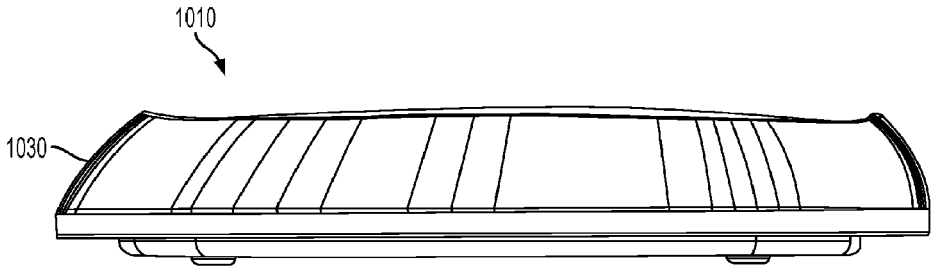
Figure 11:
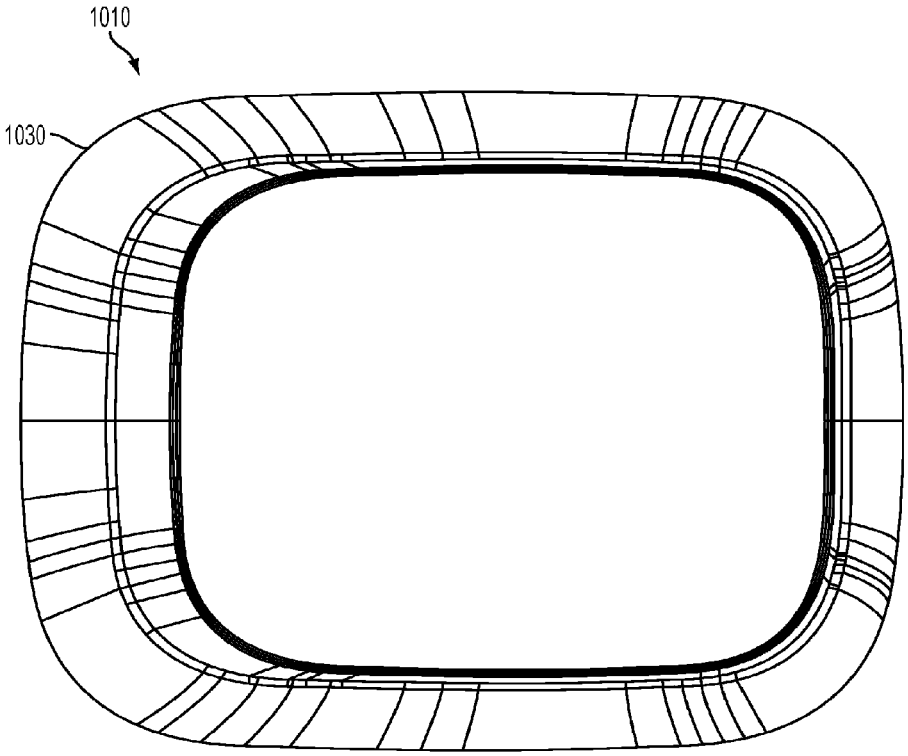
FIG. 11 is a top view of the nail lamp of FIG. 8.

FIG. 7 illustrates the overall light wavelength profile 200 of one of the clusters 130, 140, 150, 160, 170, 180, 190. The different clusters 130, 140, 150, 160, 170, 180, 190 may all have the same overall light wavelength profile or different light wavelength profiles.

As shown in FIG. 7, the different light sources 50*a*, 50*b*, 50*c* have different light wavelength profiles than each other. In particular, the overall light wavelength profile 200 of the cluster 130, 140, 150, 160, 170, 180, 190 is made up of the combination of discrete light wavelength profiles 200*a*, 200*b*, 200*c* of the discrete light sources 50*a*, 50*b*, 50*c*, respectively.

The light sources 50*a* have a light wavelength profile 200*a* that has a maximum intensity at a wavelength less than 400 nm, 390 nm, or 385 nm and/or greater than 340 nm, 350 nm, or 360 nm. According to one embodiment, the light wavelength profile 200*a* has a maximum intensity between about 360 and about 380 nm.

The light sources 50*b* have a light wavelength profile 200*b* that has a maximum intensity at a wavelength less than 430 nm, 420 nm, or 410 nm and/or greater than 380 nm, 385 nm, 390 nm, or 400 nm. According to one embodiment, the light wavelength profile 200*b* has a maximum intensity between about 385 and about 425 nm.

The light sources 50*c* have a light wavelength profile 200*c* that has a maximum intensity at a wavelength less than 470 nm, 460 nm, or 450 nm and/or greater than 410 nm, 420 nm, 425 nm, or 430 nm. According to one embodiment, the light wavelength profile 200*c* has a maximum intensity between about 430 and about 445 nm.

Each of the light wavelength profiles 200*a*, 200*b*, 200*c* is different from each other profile 200*a*, 200*b*, 200*c*.

According to various embodiments, the light wavelength profiles 200*a*, 200*b*, 200*c* of the light sources 50*a*, 50*b*, 50*c* each have a maximum intensity at a wavelength that is less than 475 nm, less than 460 nm, and/or less than 450 nm Although particular wavelengths have been described with respect to particular light sources 50*a*, 50*b*, 50*c*, the wavelengths of any and all of the light sources 50 may alternatively have any other suitable wavelengths and/or wavelength patterns without deviating from the scope of the present invention. For example, the wavelengths may be specifically tailored to cure a particular type of light-curable nail product. While the illustrated wavelengths are in the UV spectrum, wavelengths outside of the UV spectrum may additionally and/or alternatively be used, depending on what wavelength radiation is suitable for curing the targeted light-curable nail product. Indeed, the light sources may provide any type of suitable light (e.g., ultra violet, infrared, actinic radiation, other light within or outside the visible spectrum) for curing the associated light-curable nail product.

While the illustrated lamp 10 utilizes light sources 50 with different wavelength profiles, all of the light sources 50 may alternatively have the same light wavelength profile without deviating from the scope of the present invention.

As shown in FIG. 6, the array 40 of discrete light sources 50 includes one or more circuit boards 220 onto which the discrete light sources 50*a*, 50*b*, 50*c* are mounted. Each discrete light source 50*a*, 50*b*, 50*c* can be a LED that has its own discrete lens. However, according to an alternative embodiment, multiple discrete light sources 50*a*, 50*b*, 50*c* could share a single lens while still being discrete light sources 50. For example, a single lens could cover three discrete LED semiconductor junctions of three light sources 50*a*, 50*b*, 50*c*, respectively. Although the light emitted from the lens would have the combined light wavelength profiles of the light sources 50*a*, 50*b*, 50*c*, the light sources 50*a*, 50*b*, 50*c* would nonetheless be discrete from each other because their respective LED semiconductor junctions remain discrete.

According to alternative embodiments, the LED light sources 50*a*, 50*b*, 50*c* may be replaced any other suitable types of light sources 50 (e.g., florescent, gas discharge) without deviating from the scope of the present invention.

Unlike conventional nail lamps that utilize light sources that focus on a single wavelength, light sources 50*a*, 50*b*, 50*c* of lamp 10 provide a wider range of light wavelengths, which has been found to improve performance in curing one or more types of light-curable nail products. Consequently, one or more embodiments of the invention can use an array 40 of light sources 50*a*, 50*b*, 50*c* with a lower overall intensity than was used by various conventional nail lamps that focused on a single wavelength.

Use of the lamp 10 to cure light-curable nail product on a user's nail(s) is hereinafter described with reference to FIG. 1. The user moves the support 30 into the operative position and places his/her appropriate appendage into the space 110. Although described below with respect to nails on the hand (fingers), it is to be understood that the method applies to other appendages, e.g. feet, as well. The user actuates the switch 62 (if the lamp 10 is not configured to automatically turn ON), which causes the controller 60 to enter the left (or right) hand ON state and turn on the corresponding clusters of light sources 50. The light sources 50 direct light onto the uncured light-curable nail product and cure the nail product. The user then actuates the switch 62 to switch the controller 60 to the other hand's ON state (if the controller 60 does not automatically do so) and places his/her other appendage into the space 110. The controller 60 responsively turns on the corresponding light sources 50, which direct light on to the user's nails and cure the uncured light-curable nail product thereon.

FIGS. 8-11 illustrate a lamp 1010 according to an alternative embodiment of the present invention. The lamp 1010 is generally similar to the lamp 10. To avoid redundant description of similar features between the lamp 1010 and lamp 10, similar features in the lamp 1010 will be referenced by the number 1000 larger than the comparable reference number used in the lamp 10. Although the support 1030 of the lamp 1010 is slightly differently shaped than the corresponding support 30 of the lamp 10, the support 1030 remains U-shaped.

Figure 12:
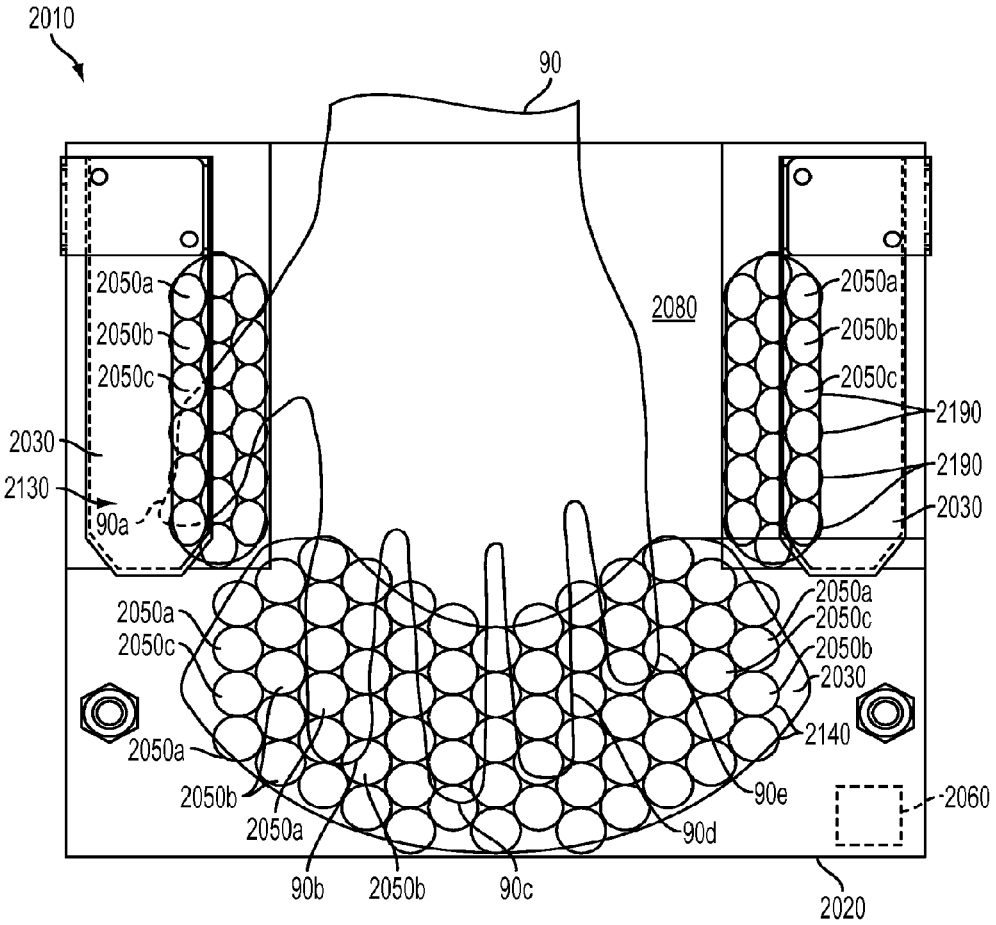
FIG. 12 is a top view of the light source configuration according to an alternative embodiment of a nail lamp.
Figure 13:
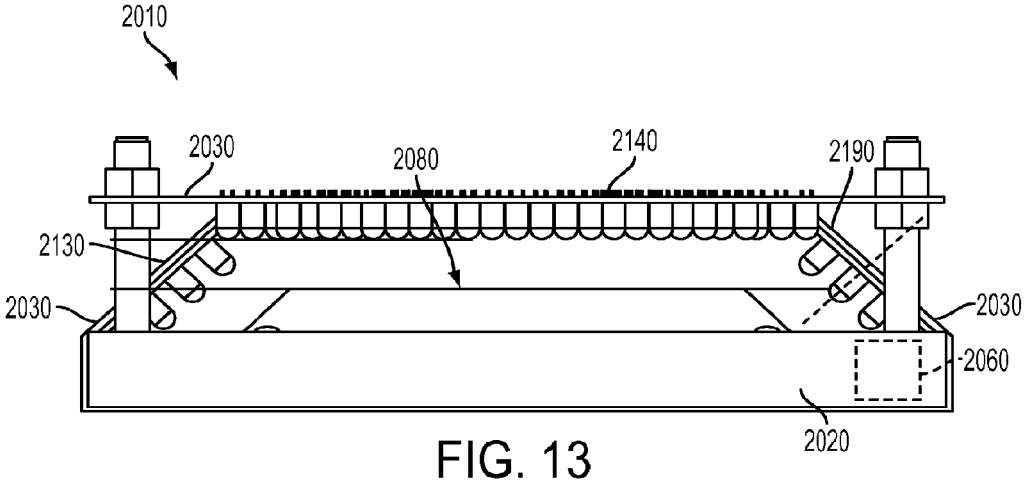
FIG. 13 is a front view of the light source configuration of the nail lamp of FIG. 12.

According to one or more alternative embodiments, two or more of the clusters 130, 140, 150, 160, 170, 180, 190 may be combined such that the light sources 50 are more evenly distributed throughout the U-shaped array 40 without deviating from the scope of the present invention. For example, FIGS. 12 and 13 illustrate a nail lamp 2010 according to an alternative embodiment. To avoid redundant description, components of the lamp 2010 that are similar to components of the lamp 10 are identified using reference numbers 2000 higher than the corresponding component in the lamp 10. The lamp 2010 is generally similar to the lamp 10 except for the consolidation of the lamp 10's clusters 140, 150, 160, 170, 180 for the nails 90*b*, 90*c*, 90*d*, 90*e* into a consolidated, U-shaped cluster 2140 of light sources 2050*a*, 2050*b*, 2050*c*. As shown in FIG. 13, the cluster 2140 is generally parallel to the upper surface of the platform 2080. As shown in FIG. 13, the clusters 2130, 2190 of light sources 2050*a*, 2050*b*, 2050*c* are oriented at a 45° angle relative to the upper surface of the platform 1080 in order to generally accommodate the orientation of the user's left and right thumb nails, respectively. Ion other embodiments, the clusters 2130, 2190 of light sources 2050*a*, 2050*b*, 2050*c* can be oriented at a 60° angle or a 90° angle relative to the upper surface of the platform 1080.

A controller 2060 of the lamp 2010 may simultaneously turn all of the clusters 2130, 2140, 2190 on or off. Alternatively, the controller 2060 may have (a) a left hand state that turns on the clusters 2130, 2140 but not the cluster 2190, and (b) a right hand state that turns on the clusters 2140, 2190 but not the cluster 2130.

In the lamp 2010, the clusters 2130, 2140, 2190 and support 2030 rigidly mount (e.g., via bolts) to the base 2020 such that the support 2030 and clusters 2130, 2140, 2190 are always in the operative position. As shown in FIGS. 12 and 13, the support 2030 contains the semiconductor substrates to which the light sources 2050*a*, 2050*b*, 2050*c* are mounted. The support 2030 additionally includes a cover (not shown) that is similar to that shown in the lamp 10.

Figure 14:
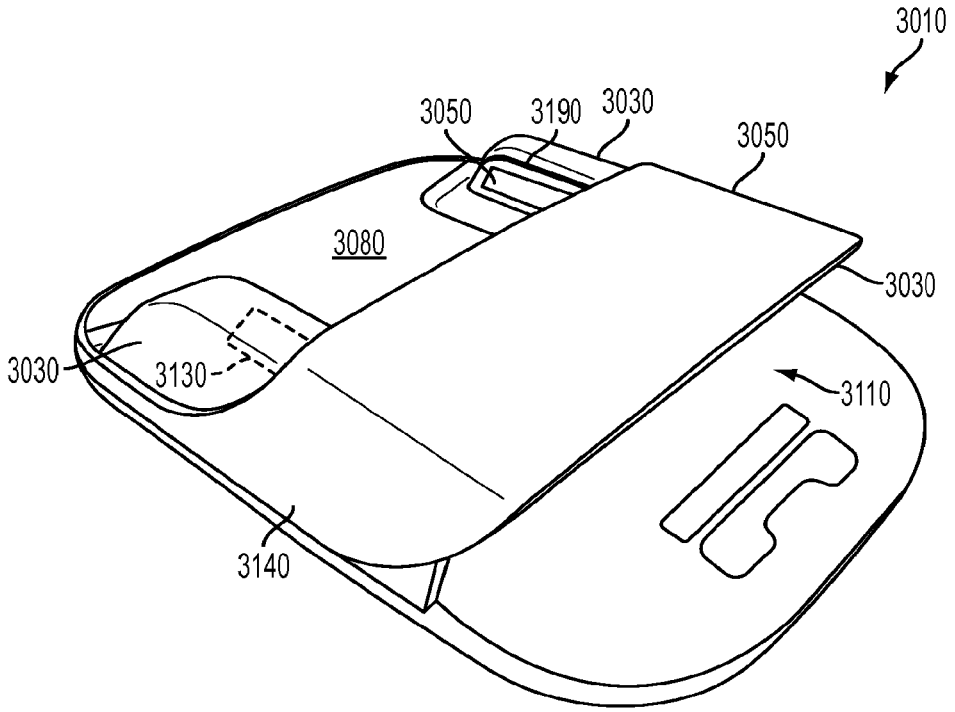
FIG. 14 is a front perspective view of a nail lamp according to an alternative embodiment.
Figure 15:
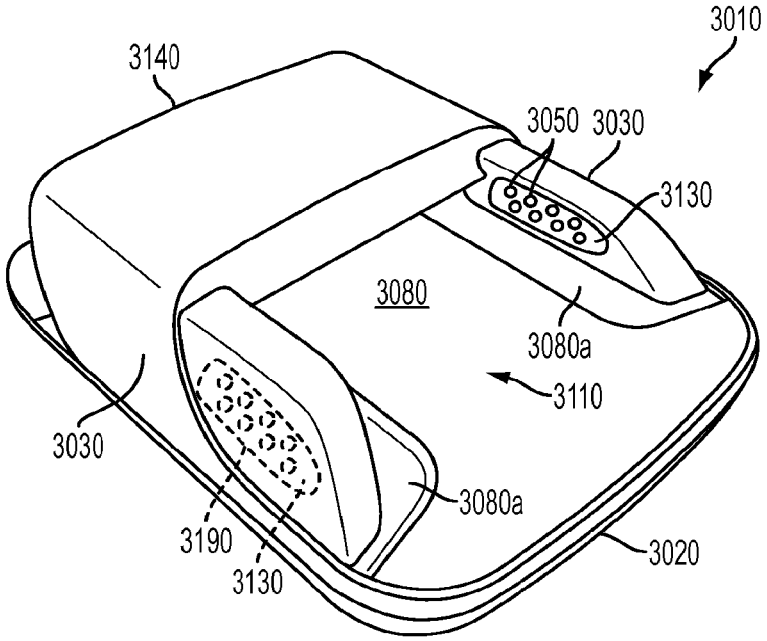
FIG. 15 is a rear perspective view of the nail lamp of FIG. 14.
Figure 16:
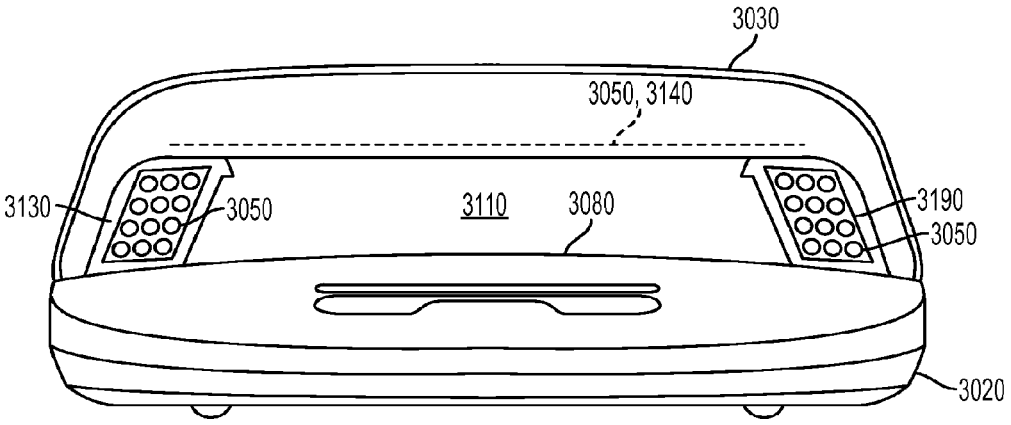
FIG. 16 is a front view of the nail lamp of FIG. 14.

FIGS. 14-16 illustrate a lamp 3010 according to an alternative embodiment of the present invention. To avoid redundant description, components of the lamp 3010 that are similar to components of the lamps 10 or 2010 are identified using comparable reference numbers in the 3000 range (e.g., base 3020 corresponds to bases 20 and base 2020 in lamp 10 and lamp 2010, respectively). The lamp 3010 is similar to the lamps 10 and 2010, except that the support 3030 is rigidly connected to the base 3020 such that the support 3030 is always in its operative position and the space 3110 is always sized to accommodate the user's appendage. As in the lamp 2010, the lamp 3010 includes three light clusters 3130, 3140, 3190 that each include light sources 3050 with different wavelength profiles. As shown in FIG. 15, the platform 3080 can include thumb depressions 3080*a* adjacent the clusters 3130, 3190. The thumb depressions 3080*a* are lower than the adjacent portion of the platform 3080 to provide for more comfortable positioning of the user's hand on the platform 3080.

FIGS. 17-20 illustrate a lamp 4010 according to an alternative embodiment of the present invention. To avoid redundant description, components of the lamp 4010 that are similar to components of the lamps 10 or 2010 are identified using comparable reference numbers in the 4000 range (e.g., base 3020 corresponds to bases 20 and base 2020 in lamp 10 and lamp 2010, respectively). Similar to lamp 3010, the support 4030 is rigidly connected to the base 4020 such that the support 4030 is always in its operative position and the space 4110 is always sized to accommodate the user's appendage. As in the lamp 3010 includes three light clusters 4130, 4140, 4190 that each include light sources 4050 with different wavelength profiles. Although not shown, the platform 4080 can optionally include thumb depressions positioned similar to thumb depressions 3080*a* of lamp 3010.

Figure 17:
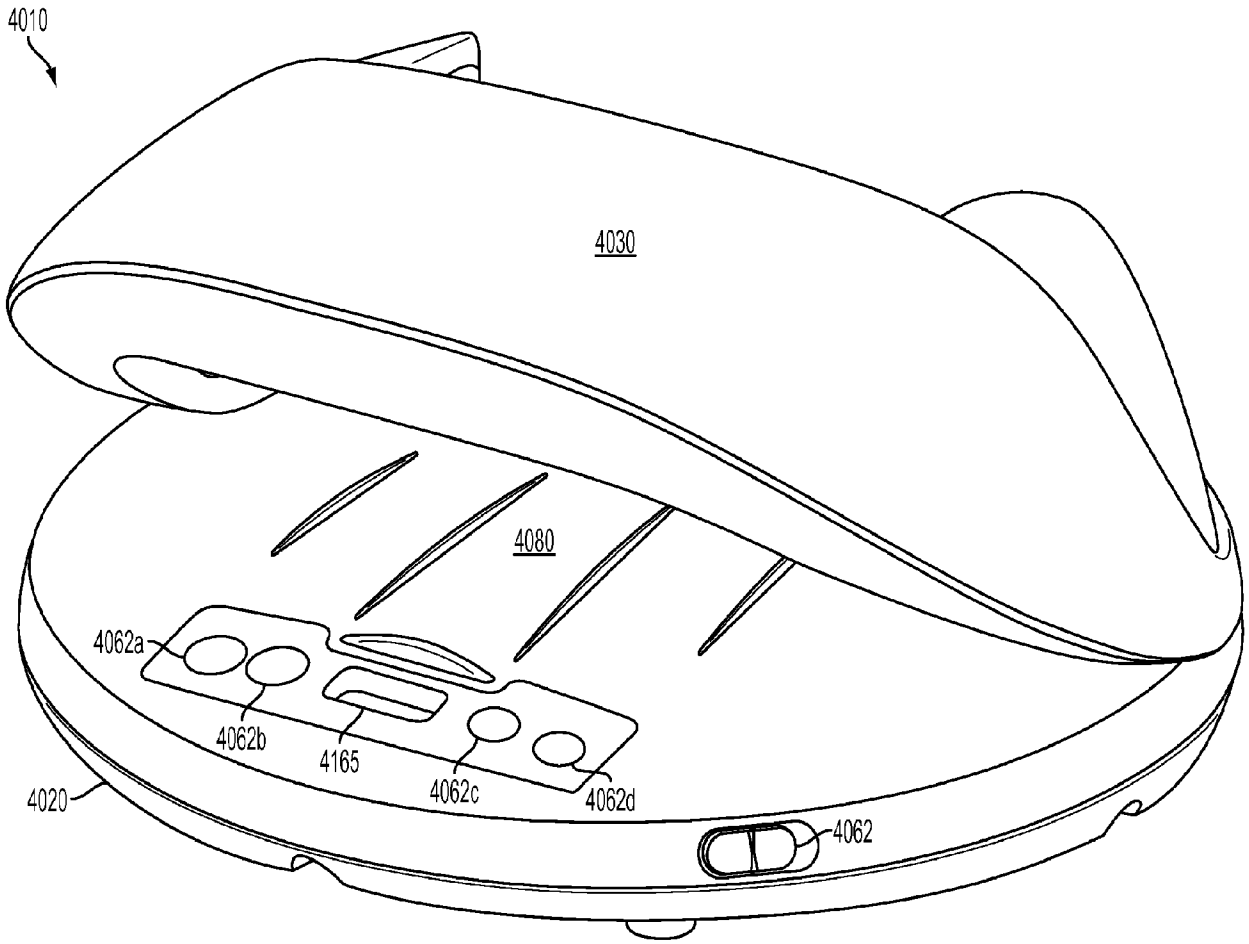
FIG. 17 is a top front perspective view of a nail lamp according to an alternative embodiment.
Figure 18:
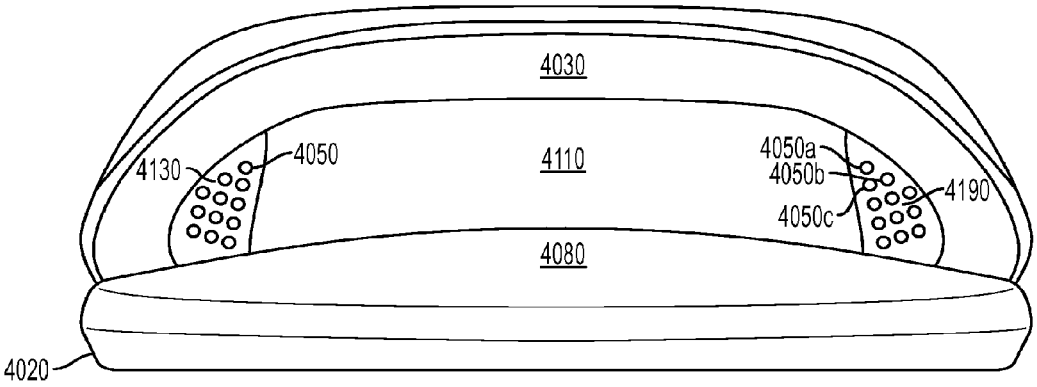
FIG. 18 is a front view of the nail lamp of FIG. 17.
Figure 19:
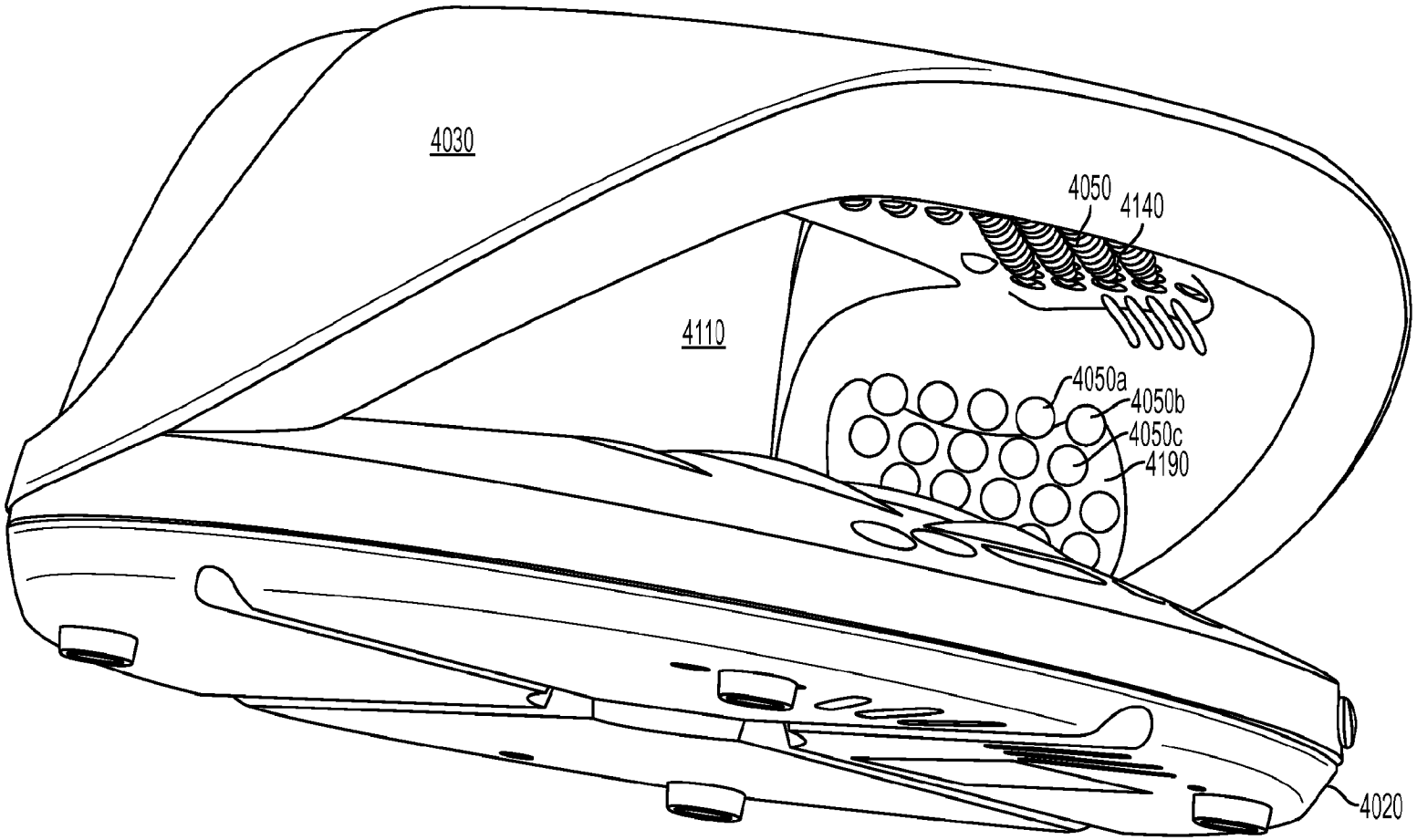
FIG. 19 is a right perspective view of the nail lamp of FIG. 17.
Figure 20:
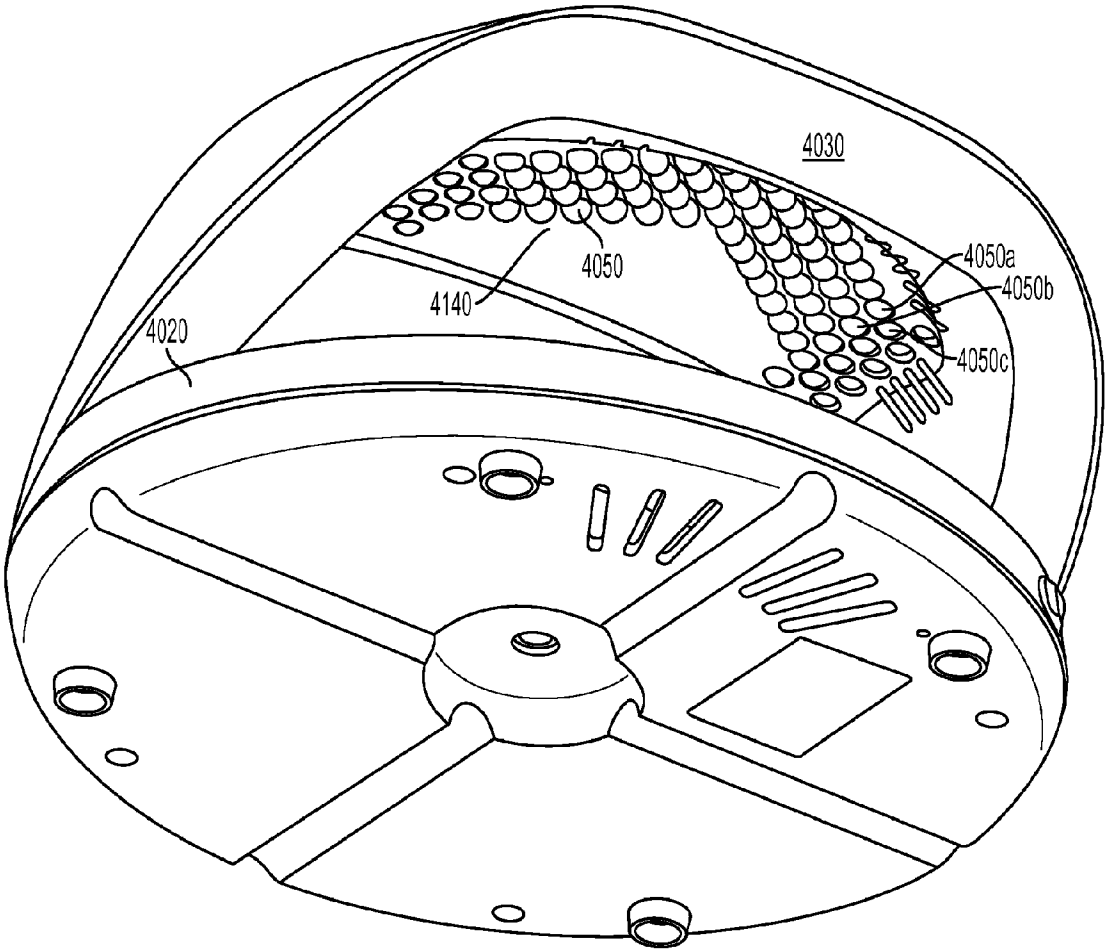
FIG. 20 is a bottom front perspective view of the nail lamp of FIG. 17.

As shown in FIG. 17, the base 4020 can include a switch 4062 which in the illustrated embodiment is on the side of base 4020. In this embodiment, the switch 4062 can operate as a simple on/off switch. Additional switches 4062*a*, 4062*b*, 4062*c*, 4062*d* in the form of buttons control aspects of the illumination of discrete light sources 4050. For example, additional switches 4062*a*, 4062*b* may set a specific time for illumination, for example 30 and 60 seconds respectively, and additional switches 4062*c*, 4062*d* may modify the illumination time by, for example, adding or subtracting time in one second increments. In these embodiments, display 4165 may be an LCD screen that indicates the set illumination time.

In other embodiments, each additional switch may be used to turn on light sources of discrete wavelengths. For example, additional switch 4062*a* may operate to turn on and off light sources 4050*a* of a first wavelength, additional switch 4062*b* may operate to turn on and off light sources 4050*b* of a second wavelength, and additional switch 4062*c* may operate to turn on and off light sources 4050*c* of a third wavelength. In such an embodiment, the display 4165 may indicate which wavelengths of light are being emitted. Alternatively, the additional switches may operate to turn on and off various arrays of discrete light sources. For example, additional switch 4062*b* may operate to turn on and off all light sources of array 4130, additional switch 4062*c* may operate to turn on and off all light sources of array 4140, and additional switch 4062*d* may operate to turn on and off all light sources of array 4190. While descried above as including three different discrete light sources 4050*a*, 4050*b* and 4050*c* with three different wavelength profiles, it will be appreciated that all discrete light sources have the same wavelength profile or that there may be two different discrete light sources 4050*a* and 4050*b* with two different wavelength profiles. The invention may include fewer or more additional switches depending upon the overall configuration and need for control. Display 4165 can take on other forms such as indicator lights similar to indicator lights 63 and 64 described above. The display 4165 may also display multiple functions, for example by including both an LCD display and indicator lights.

Figure 21:
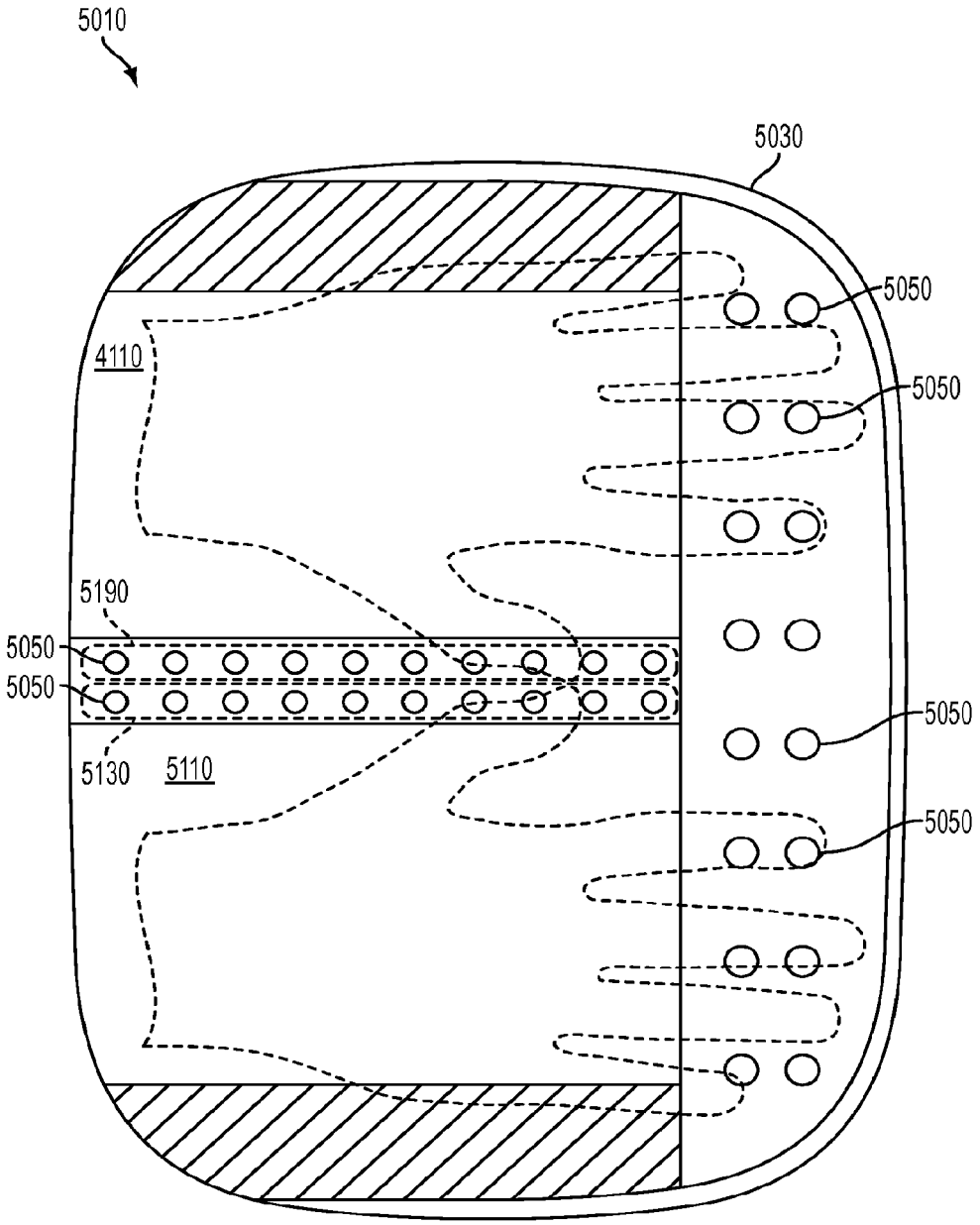
FIG. 21 is a partial bottom view of a nail lamp according to an alternative embodiment of the present invention

As shown in FIGS, 19-20, and similar to lamp 2010 illustrated in FIGS. 12-13, the illustrated embodiment of lamp 4010 clusters 140, 150, 160, 170, 180 of lamp 10 are consolidated into a V shaped cluster 4140 of light sources 4050*a*, 4050*b*, 4050*c*. The cluster 4140 is generally parallel to the upper surface of the platform 4080. The V shaped cluster 4140 generally follows the shape of the four fingers of a hand with the apex (point) of the V positioned to illuminate a middle finger and the sides positioned to illuminate the shorter ring finger, index finger and pinky finger. As in other embodiments, arrays 130, 190 are positioned in the sides of support 4030 for illuminating the thumb of the right and left hand, respectively FIG. 21 illustrates a nail lamp 5010 according to an alternative embodiment of the present invention. To avoid redundant description, components of the lamp 5010 that are similar to components of the lamps 10, 1010, 2010, 3010, 4010 are identified using comparable reference numbers in the 4000 range. The lamp 4010 is generally similar to the lamps 10, 1010, 2010, 3010, 4010, except that the lamp 5010, its support 5030, its base (not shown), its space 5110, and its light sources 5050 are configured to simultaneously accommodate all ten nails on both appendages (hands or feet) of the user so as to simultaneously cure the nail product on all ten side-by-side nails. As shown in FIG. 17, two clusters 5130, 5190 of lights 5050 divide the space 5110 into left and right sides for the user's left and right appendages, respectively. The clusters 5130, 5190 are positioned to direct light from their light sources 5050 toward the user's left and right thumb nails, respectively. The clusters 5130, 5190 may be angled (e.g., at a 30°, 45°, or 60° angle) so as to more squarely direct light onto the user's thumb nails. The two-appendage, ten nail feature of the lamp 4010 may be incorporated into any of the other lamps 10, 1010, 2010, 3010, 4010 without deviating from the scope of the invention.

In the lamps 10, 1010, 2010, 3010, 4010, 5010, the various light sources and light clusters are preferably positioned to provide a similar light-source-to-nail gap, light-source-to-nail light intensity, and light-source-to-nail angle of incidence (for example about 90° so that the light squarely hits the surface of the nails) for each of the user's nails. According to various embodiments, such consistency across the different clusters provides for more uniform curing of the nail product on the user's different nails.

The foregoing illustrated embodiments are provided to illustrate the structural and functional principles of the present invention and are not intended to be limiting. To the contrary, the principles of the present invention are intended to encompass any and all changes, alterations and/or substitutions within the spirit and scope of the following claims. For example, any features of one of the lamps 10, 1010, 2010, 3010, 4010, 5010 may be incorporated into any of the other lamps 10, 1010, 2010, 3010, 4010, 5010 without deviating from the scope of the present invention.

What is claimed:

1. A nail lamp comprising:

an array of discrete light sources, configured to cure one or more light-curable nail products, the array of discrete light sources including a first light source that emits light with a first wavelength profile having a maximum intensity at a first wavelength and a second light source that emits light with a second wavelength profile having a maximum intensity at a second wavelength, the first light source and the second light source operating in combination to cure the nail products; and a space disposed beneath the array, the space being sized to accommodate therein at least one nail on an appendage of a user, wherein the array of discrete light sources is positioned relative to the space so as to be able to expose the at least one nail to the light of both the first wavelength profile and the second wavelength profile, and wherein the first and second wavelengths are in a range from about 340 nm to about 475 nm, and differ from each other by at least 5 nm, and wherein the light of the first wavelength in combination with the light of the second wavelength cures at least one of the light-curable nail products more rapidly and at a lower overall light intensity than the light of only the first wavelength or the light of only the second wavelength.

2. The nail lamp of claim 1, wherein:

the first wavelength is in a range from about 360 nm to about 380 nm, and the second wavelength is in a range from about 385 nm to about 425 nm.

3. The nail lamp of claim 1, wherein:

the first wavelength is in a range from about 340 nm to about 385 nm, and the second wavelength is in a range from about 390 nm to about 430 nm.

4. The nail lamp of claim 1, wherein:

the first wavelength is in a range from about 340 nm to about 390 nm, and the second wavelength is in a range from about 400 nm to about 430 nm.

5. The nail lamp of claim 1, wherein:

the first wavelength is in a range from about 340 nm to about 400 nm, and the second wavelength is in a range from about 410 nm to about 475 nm.

6. The nail lamp of claim 1, wherein:

the first wavelength is in a range from about 360 nm to about 385 nm, and the second wavelength is in a range from about 390 nm to about 410 nm.

7. The nail lamp of claim 1, wherein:

the first wavelength is about 365 nm, and the second wavelength is about 405 nm.

8. The nail lamp of claim 1, wherein:

the array exposes the at least one nail to the light of the first wavelength profile, and the light of the second wavelength profile simultaneously.

9. The nail lamp of claim 1, wherein:

the array of discrete light sources includes a third light source with a third wavelength profile having a maximum intensity at a third wavelength, and the third wavelength differs from each of the first and second wavelengths by at least 5 nm.

10. The nail lamp of claim 9, wherein the third wavelength is in a range from about 410 nm to about 470 nm.

11. The nail lamp of claim 9, wherein the third wavelength is in a range from about 410 nm to about 450 nm.

12. The nail lamp of claim 1, wherein the space is sized to accommodate therein five nails on an appendage of the user.

13. The nail lamp of claim 1, wherein the space is sized to accommodate therein ten nails on two appendages of the user.

14. The nail lamp of claim 1, wherein each of the light sources may be selectively turned on and off individually or together in a group of the light sources.

15. The nail lamp of claim 1, wherein the space disposed beneath the array is substantially open to an ambient environment.

16. The nail lamp of claim 1, wherein the space disposed beneath the array is substantially open to an ambient environment at a front and a rear regions of the space.

17. The nail lamp of claim 1, wherein the first light source is an LED light source and the second light source is an LED light source.

18. The nail lamp of claim 1, wherein the first light source is an LED light source and the second light source is a fluorescent light source or a gas discharge light source.

19. The nail lamp of claim 9, wherein the third light source is an LED light source.

20. The nail lamp of claim 9, wherein the third light source is a fluorescent light source or a gas discharge light source.

* * * * *